US009383100B1

(12) United States Patent
Russell

(10) Patent No.: US 9,383,100 B1
(45) Date of Patent: Jul. 5, 2016

(54) MAGNETICALLY MANAGED COMBUSTION

(75) Inventor: James C. Russell, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 982 days.

(21) Appl. No.: 13/596,057

(22) Filed: Aug. 28, 2012

(51) Int. Cl.
*F23L 7/00* (2006.01)
*F23J 7/00* (2006.01)
*C10L 10/02* (2006.01)

(52) U.S. Cl.
CPC ... *F23J 7/00* (2013.01); *C10L 10/02* (2013.01)

(58) Field of Classification Search
USPC ..... 431/8, 4
See application file for complete search history.

(56) References Cited

U.S. PATENT DOCUMENTS 3,480,806 A * 11/1969 Bertold ..... H02K 44/08 310/11
4,134,034 A * 1/1979 Dardai ..... H05H 1/52 310/11
7,963,115 B1 * 6/2011 Sondergaard ..... F01K 13/00 123/536

OTHER PUBLICATIONS

A.S. Rubin, S.H. Zaidi, and R.B.Miles, "Thrust vectoring of laser-ablated aluminum plasma using permanent magnets", Department of Mechanical and Aerospace Engineering, Princeton University, Princeton, New Jersey, 08544.
Tachiki, M., and Kobayashi, T., "Manipulation of Laser Ablation Plume by Magnetic Field Application," Japanese Journal of Applied Physics, vol. 38., 1999, pp. 3642-3645.
Harilal, S.S., Tilack, M.S., Bindu, C.V., and Najmabadi, F., "Confinement and Dynamics of Laser-Produced Plasma Expanding Across a Transverse Magnetic Field," Physical Review E, vol. 69, 2004, pp. 26413-26424.
Zaidi, S. H., Smith, T. W., Murray, R., Miles, R. B., "Magnetically Guided Laser Ablation for High Specific Impulse Thrusters," 43rd AIAA Aerospace Sciences Meeting and Exhibit, 2005, pp. 365-377.
Lash, J. S., Gilgenbach, R. M., and Ching, C. H., Laser Ablation Assisted Plasma Discharges of Aluminum in a Transverse-Magnetic Field, Applied Physics Letters, vol. 65, 1994, pp. 531-533.

* cited by examiner

*Primary Examiner* — Avinash Savani
(74) *Attorney, Agent, or Firm* — McDonnell Boehnen Hulbert & Berghoff LLP

(57) ABSTRACT

A system and methods for magnetically managing combustion are presented. Fuel is injected into a magnetic field at least partially enclosed in a combustion chamber, and a combustion region comprising electrically conductive species is produced by combusting the fuel. The combustion region is magnetically controlled using the magnetic field operating on the electrically conductive species.

14 Claims, 4 Drawing Sheets

MAGNETICALLY MANAGED COMBUSTION

FIELD

Embodiments of the present disclosure relate generally to combustion. More particularly, embodiments of the present disclosure relate to combustion control.

BACKGROUND

Use of lower-cost heavy residue bunker fuel, particularly in marine diesel powerplants, often results in an engine operational anomaly due to a slower flame front dwelling too long in a cylinder, and burning oil film off walls of the cylinder. This may cause greatly increased wear from piston ring abrasion, resulting in reduced engine life or a non-optimal engine state. Use of a fuel which has too much heavy content can rapidly deteriorate a powerplant, requiring expensive repair/rebuild.

In addition, biodiesel fuel has not generally been widely adopted for use in consumer automobiles in some cases because a flame speed for biodiesel fuel is generally slower than a flame speed for conventional diesel fuel. This can mean that the biodiesel fuel may not be completely consumed before an operating phase of an engine opens exhaust valves. Not completely consuming the biodiesel fuel can lead to greatly reduced fuel economy and potential thermal engine anomaly. Increasing the flame speed of biodiesel would make biodiesel more suitable for use in consumer or other high rpm diesel engines.

SUMMARY

A system and methods for magnetically managing combustion are presented. Fuel is injected into a magnetic field at least partially enclosed in a combustion chamber, and a combustion region comprising electrically conductive species is produced by combusting the fuel. The combustion region is magnetically controlled by induced eddy currents using the magnetic field operating on the electrically conductive species to dynamically control combustion characteristics such as pressure, temperature, position, velocity, rate of combustion, geometry, and other combustion characteristics of the combustion region.

In this manner, embodiments of the disclosure provide a means to compress and confine a combustion region (e.g., the combustion region in a cylinder of an internal combustion engine such as a diesel engine or turbine engine) preventing or minimizing flame contact with fixed structures such as cylinder walls and turbine engine burner walls. For cylinder walls, a pulsed magnetic field may be applied at a correct point in an injection/combustion cycle. Thereby, formation and evolution of the combustion region may be controlled providing protection from long-duration combustion such as removal of a protective oil film from the cylinder walls.

For turbine engine burner walls, thermal load is reduced on burner supports and surrounding ducts, and an operating life of the turbine engine burner walls is increased. In addition, a magnetic confinement and a flame compression can be modulated at high frequency, and a pressure output from each burner can be balanced and rapid chaotic pressure variations may be damped. Thereby, engine noise can be reduced and turbine blade lifetime increased. Also, during lean engine operation, active flame control can prevent a flame entering a chaotic sputtering mode which produces significant acoustic pulses capable of causing an anomaly to a turbine if resonances form.

In an embodiment, a method for magnetically managing combustion injects a fuel into a magnetic field at least partially enclosed in a combustion chamber, and produces a combustion region comprising electrically conductive species by combusting the fuel. The method further magnetically controls the combustion region using the magnetic field operating on the electrically conductive species.

In another embodiment, a magnetic combustion management system comprises a combustion chamber and a magnet. The combustion chamber produces a combustion region comprising electrically conductive species by combusting a fuel, and the magnet controls the combustion region using the magnetic field operating on the electrically conductive species.

In a further embodiment, a method for forming a magnetic combustion management system configures a combustion chamber that produces a combustion region comprising electrically conductive species by combusting a fuel. The method further configures a magnet that controls the combustion region using the magnetic field operating on the electrically conductive species.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF DRAWINGS

A more complete understanding of embodiments of the present disclosure may be derived by referring to the detailed description and claims when considered in conjunction with the following figures, wherein like reference numbers refer to similar elements throughout the figures. The figures are provided to facilitate understanding of the disclosure without limiting the breadth, scope, scale, or applicability of the disclosure. The drawings are not necessarily made to scale.

DETAILED DESCRIPTION

The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to combustion, diesel engines, turbine combustors, magnets, electronic circuits, electrical devices, and other functional aspects of systems described herein (and the individual operating components of the systems) may not be described in detail herein. In addition, those skilled in the art will appreciate that embodiments of the present disclosure may be practiced in conjunction with a variety of hardware and software, and that the embodiments described herein are merely example embodiments of the disclosure.

Embodiments of the disclosure are described herein in the context of a non-limiting application, namely, intermittent and continuous combustion. Embodiments of the disclosure, however, are not limited to such intermittent and continuous combustion applications, and the techniques described herein may also be utilized in other applications. For example but without limitation, embodiments may be applicable to conductive gas flow control, stabilization of conductive gas flows, reduction or augmentation of turbulence in conductive gas flows, or other fluid control applications.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

Figure 1:
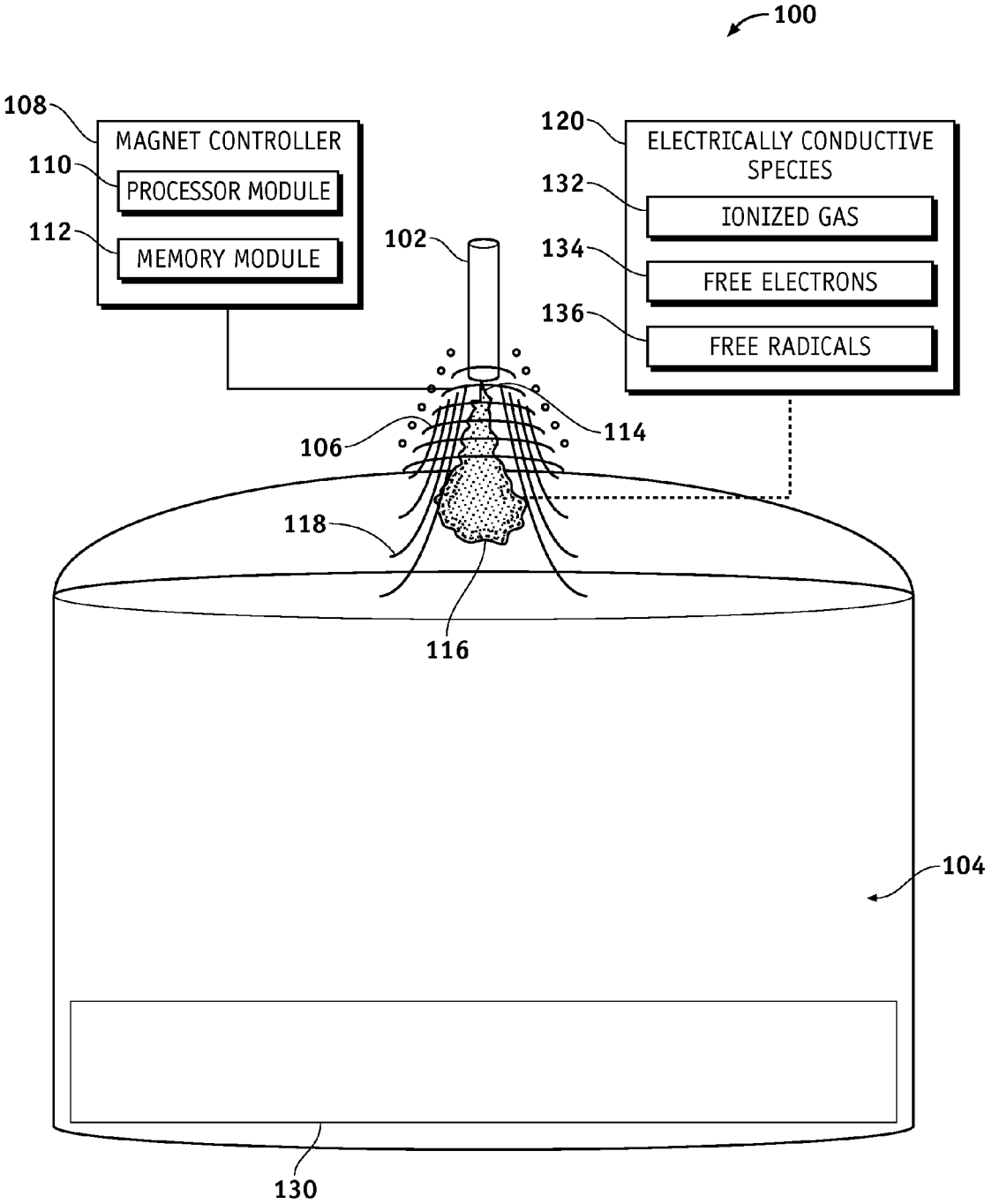
FIG. 1 is an illustration of an exemplary magnetic combustion management system for a diesel engine cylinder according to an embodiment of the disclosure.

FIG. 1 is an illustration of an exemplary magnetic combustion management system 100 for a diesel engine cylinder according to an embodiment of the disclosure. The system 100 comprises a fuel injector 102, a combustion chamber 104, an electromagnet 106, and a magnet controller 108.

The fuel injector 102 is configured to inject a fuel 114 into the combustion chamber 104. The fuel 114 may comprise, for example but without limitation, a heavy residue bunker fuel, diesel fuel, or other fuel. As mentioned above, use of lower-cost heavy residue bunker fuel, particularly in existing marine diesel engines, may result in engine anomaly due to a slower flame front dwelling too long in an existing combustion chamber. Furthermore, burning an oil film off cylinder walls of an existing combustion chamber may act to greatly increase wear from piston ring abrasion, resulting in reduced engine life or a non-optimal engine state. Use of fuel which has too much heavy content can render an engine into a non-optimal condition, requiring repair/rebuild.

In addition, biodiesel has not been adopted for use in consumer automobiles in part because a flame speed is slower than for conventional diesel fuel, as a result the biodiesel may not be completely consumed before a phase of the diesel engine opens exhaust valves. A longer duration of biodiesel combustion limits a maximum rpm of a diesel engine. A modification to a conventional internal combustion engine described herein provides an increase in flame speed of biodiesel and can make biodiesel suitable for use in consumer high-rpm diesel applications such as automobiles.

The combustion chamber 104 is operable to combust the fuel 114 to produce electrically conductive species 120 in a combustion region 116 which have high velocity. The electrically conductive species 120 may comprise, for example but without limitation, an ionized gas 132, free electrons 134, free radicals 136, or other conductive species. The fuel 114 is injected under high pressure into the combustion chamber 104 which contains air which is compressed to, for example but without limitation, about 40 bars and consequently heated to, for example but without limitation, approximately 260 degrees C. (500 degrees F.). Such conditions are generally above an auto-ignition state for diesel fuel, which generally ignites immediately upon injection as a fine mist evaporates and mixes with oxidizer (e.g., air). In the embodiment shown in FIG. 1, the combustion region 116 comprises an initial volume of fuel (flame kernel) which immediately mixes with compressed and heated air, then ignites and expands.

Initial injection of the fuel 114 causes a pressure spike in the combustion chamber 104 (cylinder). The pressure spike then falls in pressure as the fuel 114 cools surrounding air by evaporation. An outer edge of the fuel 114 (injection volume) may comprise a substantially ideal fuel/air ratio for combustion, which may spontaneously occur, creating the combustion region 116, which expands to substantially fill the combustion chamber 104. In multi-component fuels, lightest fractions (e.g., most easily burned fuel components) of the fuel 114 are consumed rapidly leading to a sharp pressure rise. Subsequent combustion of denser components of the fuel 114 produces a longer-duration pressure increase. The sharp pressure rise and the longer-duration pressure increase contribute to a total pressure which pushes a piston 130, which turns a crankshaft (not shown) in an internal combustion piston engine.

The magnet 106 encloses the combustion region 116 in a magnetic field 118. The magnet 106 may comprise, for example but without limitation, an electromagnet, a permanent magnet, or other suitable magnet. Fuel chemistry affects a temperature and a peak pressure of the combustion region 116, and also an inter-peak interval and a dwell time of a secondary pressure pulse. Magnetic confinement of the combustion region 116 can occur because fuel/air combustion produces the electrically conductive species 120. Hydrocarbon fuels can exhibit conductivities measured to be $10^5$ times higher than predicted from only thermal ionization of reactive species at combustion temperature due to conductive species in addition to thermal ionized reactive species.

Electrically conductive materials experience a physical drag force when attempting to move across lines of the magnetic field 118 due to formation of eddy currents which act to oppose the magnetic field 118. Thus, the combustion region 116 is subject to inward-directed forces (e.g., directed toward a center of the combustion region 116), which act to compress and elongate the combustion region 116 in a direction of the magnetic field 118. The inward-force may be especially strong if the magnetic field 118 is growing in strength as the combustion region 116 is expanding because a velocity of a moving field gradient is added to a velocity of a moving combustion front and because magnetically-useful forces (F) are a cross product (x) of field strength (B) and velocity (v) based on an $F=v \times B$ relationship.

Magnetically-confined diesel combustion can attain higher combustion temperatures than conventional diesel-cycle combustion, further increasing electrical conductivity of the combustion region 116. Increased conductivity makes magnetic manipulation of the combustion region 116 more feasible by spatially-varying the magnetic field 118, which then acts to push combustion forward and allow the combustion region 116 to be moved around within the combustion chamber 104.

Generation of rapidly spatially varying fields can cause distribution of the combustion region 116 to be accelerated as the combustion region 116 is driven by the rapidly spatially varying fields to greatly increase an expansion and mixing rate resulting in a shorter combustion period. This can result in a higher temperature and reaction rate as well as rapid expansion that reduces a depth and duration of a dip between pressure peaks and reduces a time that combustion takes place. Reduced combustion time can limit erosion of a resident oil film on walls of the combustion chamber 104, and allow use of very heavy low-cost fuels that may otherwise be unusable in some applications.

The magnet controller 108 controls the magnet 106 to magnetically control the combustion region 116 using the magnetic field 118. The magnet controller 108 manages combustion of the fuel 114 by magnetically confining the combustion region 116 to a smaller volume than the combustion region 116 would occupy without the magnetic field 118. The magnet controller 108 manages magnetic confinement of the magnetic field 118 to increase a pressure of the combustion region 116, increasing temperatures and also increasing a combustion rate.

Increased rate of combustion allows conventional engine timing to operate with fuel which has an intrinsically slower flame speed such as biodiesel. This enhances use of biodiesel in smaller engines such as consumer automobiles, which are rpm-limited by a slower flame propagation rate of unaided biodiesel. By combusting biodiesel with magnetic containment (magnetic kernel containment) of the combustion region 116, higher rpms may be attained. In addition, induction of faster combustion can allow slower flame fuels such as heavy bunker fuel used in ocean-going container ships to be burned in large engines without anomaly due to oil film depletion from cylinder wall burn-off.

The magnet controller 108 may comprise a processor module 110 and a memory module 112. The processor module 110 is configured to support a magnetically managed combustion system as described herein. For example but without limitation, the processor module 110 may be suitably configured to control the magnet 106, sensors 224/226 (FIG. 2), or other function of the system 100. Furthermore, the steps of a method or algorithm described in connection with the embodiments disclosed herein may be embodied directly in hardware, in firmware, in a software module executed by processor module 110, or in any combination thereof.

The processor module 110 may be implemented, or realized, with a general purpose processor, a content addressable memory, a digital signal processor, an application specific integrated circuit, a field programmable gate array, any suitable programmable logic device, discrete gate or transistor logic, discrete hardware components, or any combination thereof, designed to perform the functions described herein. In this manner, a processor may be realized as a microprocessor, a controller, a microcontroller, a state machine, or the like. A processor may also be implemented as a combination of computing devices comprising hardware and/or software, e.g., a combination of a digital signal processor and a microprocessor, a plurality of microprocessors, one or more microprocessors in conjunction with a digital signal processor core, or any other such configuration.

The memory module 112 may comprise a data storage area with memory formatted to support operation of the system 100. The memory module 112 is configured to store, maintain, and provide data as needed to support functionality of the system 100. For example but without limitation, the memory module 112 may store fuel mix data, combustion temperature, or other data.

In some embodiments, the memory module 112 may comprise, for example but without limitation, a non-volatile storage device (non-volatile semiconductor memory, hard disk device, optical disk device, and the like), a random access storage device (for example, SRAM, DRAM), or any other form of storage medium known in the art.

The memory module 112 may be coupled to the processor module 110 and configured to store, for example but without limitation, a database, a computer program that is executed by the processor module 110, an operating system, an application program, tentative data used in executing a program, or other application. Additionally, the memory module 112 may represent a dynamically updating database containing a table for updating the database, and the like.

The memory module 112 may be coupled to the processor module 110 such that the processor module 110 can read information from and write information to the memory module 112. For example, the processor module 110 may access the memory module 112 to access fuel mix data, combustion temperature data, or other data.

As an example, the processor module 110 and memory module 112 may reside in respective application specific integrated circuits (ASICs) or other programmable devices. The memory module 112 may also be integrated into the processor module 110. In an embodiment, the memory module 112 may comprise a cache memory for storing temporary variables or other intermediate information during execution of instructions to be executed by the processor module 110.

Figure 2:
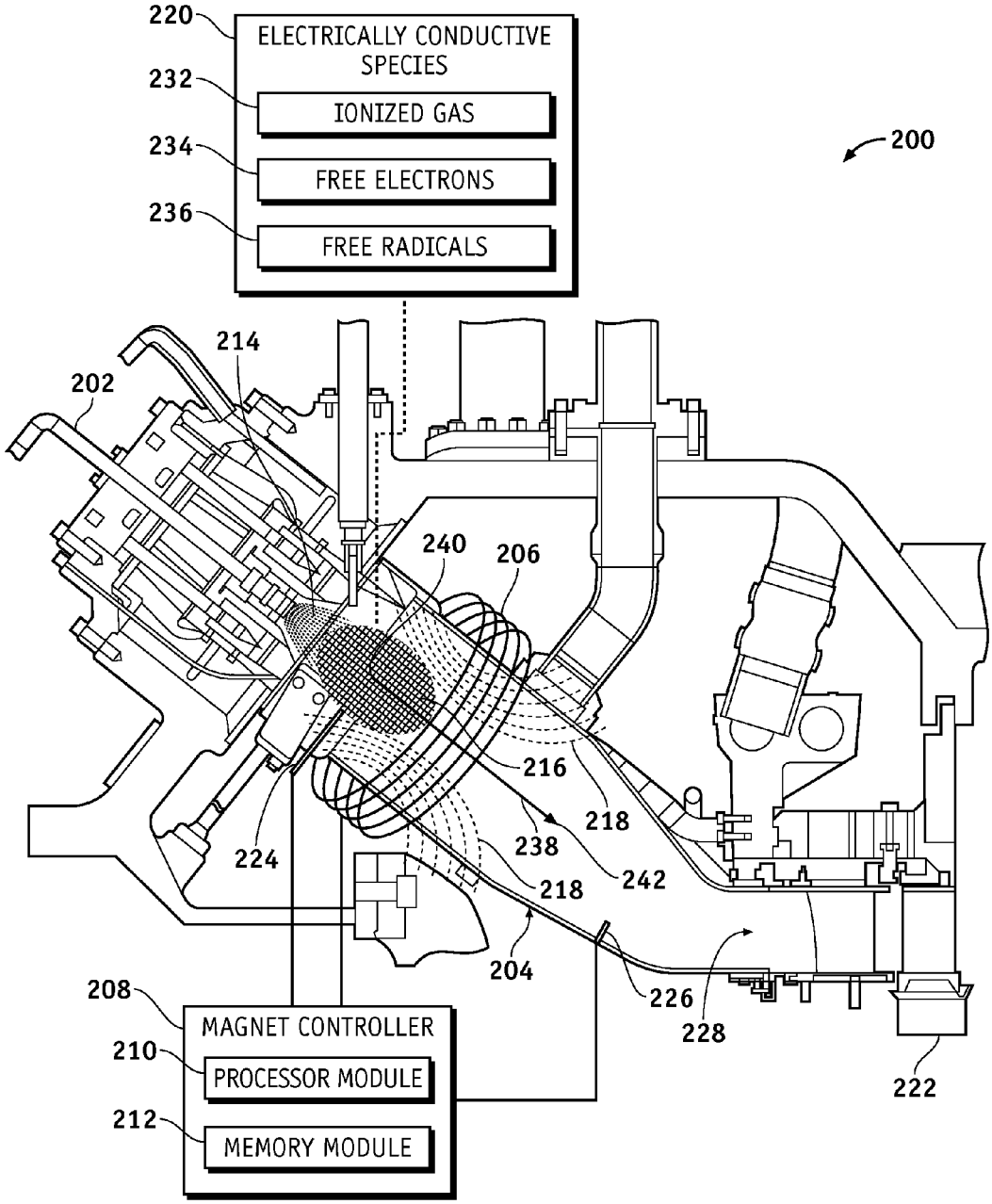
FIG. 2 is an illustration of an exemplary magnetic combustion management system for a turbine engine combustor according to an embodiment of the disclosure.

FIG. 2 is an illustration of an exemplary magnetic combustion management system 200 for a turbine engine combustor according to an embodiment of the disclosure. The system 200 comprises a fuel injector 202, a combustion chamber 204, an electromagnet 206, and a magnet controller 208. The system 200 may comprise functions, materials, and structures that are similar to the embodiments shown in FIG. 1. Therefore, common features, functions, and elements may not be redundantly described here.

The fuel injector 202 is configured to inject a fuel 214 into the combustion chamber 204. The fuel 214 is injected into the combustion chamber 204 where the fuel 214 mixes with air, forms a combustible fuel/air mixture, and ignites to form an ignited combustion which produces a combustion region 216. It is desirable for the combustion region 216 to progress smoothly to an exhaust plenum 228. However, when a fuel/air mixture comprising the fuel 214 comprises a lean mixture, the combustion region 216 may exhibit stuttering pulsations (a.k.a., rumble). The pulsations may lead to acoustic resonances in a turbine rotor 222, which may render the turbine rotor 222 non-optimal. Currently, issues of noise and burner lifetime are managed by addition of noise-dampening external structures to the exhaust plenum 228, and by replacement of affected burner components, which may add to weight, initial cost and maintenance cost.

The combustion chamber 204 is configured to combust the fuel 214 to produce electrically conductive species 220 in a combustion region 216. The electrically conductive species 220 may comprise, for example but without limitation, an ionized gas 232, free electrons 234, free radicals 236, or other conductive species. The system 200 manages combustion of the fuel 214 in the combustion chamber 204 by magnetically confining the combustion region 216 in a magnetic field 218. The magnetic field 218 confines the combustion region 216 to a smaller axial dimension than the combustion region 216 would occupy without the magnetic field 218. The magnetic field 218 acts to increase a pressure of the combustion region 216, thereby increasing temperatures as well as providing a means to partially prevent direct flame impingement on engine structures for increased life and reduced thermal stress. The magnetic field 218 can also protect the combustion chamber 204 from high surface temps and thermal erosion from direct flame impingement.

The magnet 206 encloses the combustion region 216 in the magnetic field 218. The magnet 206 may comprise, for example but without limitation, an electromagnet, a permanent magnet, or other suitable magnet. In the embodiment shown in FIG. 2, the magnet 206 comprises magnetic coils in and around the combustion chamber 204 (burner can) that provide flame shaping and flame kernel modulation to directly control pressure and burn fluctuations. The magnetic field 218 may generate a strong radial compression that is feasible in the combustion region 216 within the magnetic field 218. The combustion region 216 is thereby guided to follow an axis of the magnetic field 218 as opposed to expanding quasi-spherically without the magnetic field 218. Thereby, strong interactions between static and dynamic magnetic fields of the magnetic field 218 and the combustion region 216 allow control of the combustion region 216.

The magnet controller 208 controls the magnet 206 to magnetically control the combustion region 216 using the magnetic field 218. Control of the combustion region 216 can be used to steer plasma expansion and provide physical compression effects on the combustion region 216 to produce a magnetically-managed jet fuel combustor such as the system 200 with multiple operational benefits. The magnet controller 208 provides thermal advantages by keeping the combustion region 216 away from walls of the combustion chamber 204. Furthermore, the magnet controller 208 provides active control of noise, rumble, and low frequency pulsations by rapidly controlling the combustion region 216 to reduce pressure fluctuations of the combustion region 216.

An upstream property such as local heat release is sensed from the combustion region 216 by an upstream sensor 224 located immediately upstream 240 (e.g., relative to a direction of a flow 238) from the magnet 206. The magnet controller 208 may drive a current in the magnet 206 in anti-phase so that magnetic pressure from the magnet 206 is increased when an upstream heat release (e.g., a heat release upstream 240 relative to the direction of the flow 238) peaks, and is decreased when the upstream heat release experiences a reduction. In this way, pressure downstream 242 (e.g., relative to the direction of the flow 238) of the magnet 206 sensed by a downstream sensor 226 is smoothed and greatly reduces a magnitude of pulsations. Thereby, the magnet controller 208 provides a throttling or smoothing control of the combustion region 216.

The magnet controller 208 may comprise additional sensors such as, but without limitation, a temperature sensor, a pressure sensor, an exhaust gas temperature sensor, or other sensors. Sensors such as the upstream sensor 224 and the downstream sensor 226, and the magnet 206 may be used by the magnet controller 208 to control a pressure of the combustion region 116/216, the flow 238 of the combustion region 116/216, a dimension of the combustion region 116/216, or other properties of the combustion region 116/216.

The upstream sensor 224 may be used to sense an upstream property of the combustion region 116/216 (i.e., a property of the combustion region 116/216 at a location upstream 240 relative to the direction of the flow 238) such as, but without limitation, a heat release, a velocity, a density or other property of the combustion region 116/216 at a location of the combustion region 116/216 upstream 240 relative to the direction of the flow 238 of the combustion region 116/216 (e.g., at the upstream sensor 224).

The downstream sensor 226 may be used to sense a downstream property of the combustion region 116/216 (i.e., a property of the combustion region 116/216 at a location downstream 242 relative to the direction of the flow 238) such as, but without limitation, a pressure, a velocity, a density or other property of the combustion region 116/216 at a location of the combustion region 116/216 downstream 242 relative to the direction of the flow 238 of the combustion region 116/216 (e.g., at the downstream sensor 226). For example but without limitation, the magnet controller 208 may adaptively control a downstream property of the flow 238 of the combustion region 116/216 by: increasing the magnetic field 118/218 in response to a peak of an upstream property of the flow 238 of the combustion region 116/216, and decreasing the magnetic field 118/218 in response to a reduction of the upstream property.

The magnet controller 208 acts to compress and confine the combustion region 216, thereby allowing engine operation without the combustion region 216 directly impinging on the combustion chamber 204. Thereby, thermal load on supports and surrounding ducts for the combustion chamber 204 may be greatly reduced, thereby increasing operating life. In addition, confinement and flame compression of the combustion region 216 by the magnetic field 218 can be modulated at a high frequency by the magnet controller 208 controlling the magnet 206. Thereby, a pressure output from each of multiple combustion chambers such as the combustion chamber 204 in a turbine engine can be balanced and rapid chaotic pressure variations between different burners of the turbine engine can be damped reducing engine noise and increasing turbine blade lifetime.

Furthermore, the magnet controller 208 may control the combustion region 216 during engine operation when the fuel 214 is a lean mixture to prevent the combustion region 216 entering a chaotic sputtering mode. Such a chaotic sputtering mode in a conventional engine may produce significant acoustic pulses capable of rendering a turbine such as the turbine rotor 222 non-optimal if resonances form.

The magnet controller 208 may comprise any suitable control system known in the art. Furthermore, the magnet controller 208 may comprise a processor module 210 and a memory module 212. The processor module 210 and the memory module 212 may function in a manner similar to the processor module 110 and the memory module 112 respectively described above.

Figure 3:
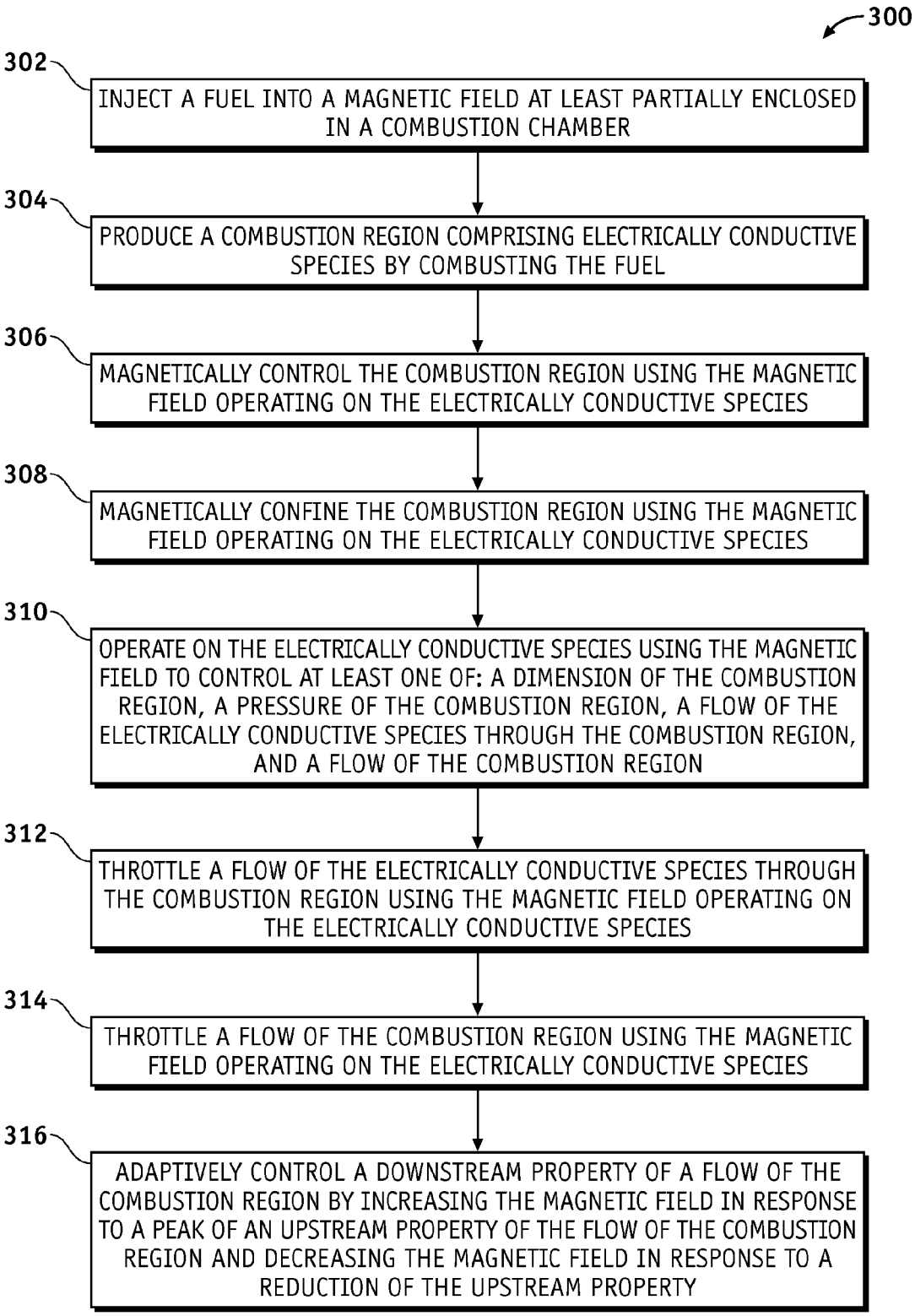
FIG. 3 is an illustration of an exemplary process for magnetically managing combustion according to an embodiment of the disclosure.

FIG. 3 is an illustration of an exemplary process 300 for magnetically managing combustion according to an embodiment of the disclosure. The various tasks performed in connection with process 300 may be performed by software, hardware, firmware, computer-readable software, computer readable storage medium, a computer-readable medium comprising computer executable instructions for performing the process method, mechanically, or any combination thereof. The process 300 may be recorded in a computer-readable medium such as a semiconductor memory, a magnetic disk, an optical disk, and the like, and can be accessed and executed, for example, by a computer CPU such as the processor module 110/210 in which the computer-readable medium is stored.

For illustrative purposes, the following description of process 300 may refer to elements mentioned above in connection with FIGS. 1-2. In some embodiments, portions of the process 300 may be performed by different elements of the systems 100-200 such as: the fuel injector 102/202, the combustion chamber 104/204, the electromagnet 106/206, the magnet controller 108/208, the fuel 114/214, the combustion region 116/216, the magnetic field 118/218, etc. It should be appreciated that the process 300 may include any number of additional or alternative tasks, the tasks shown in FIG. 3 need not be performed in the illustrated order, and the process 300 may be incorporated into a more comprehensive procedure or process having additional functionality not described in detail herein. Process 300 may comprise functions, material, and structures that are similar to the embodiments shown in FIGS.

1-2. Therefore, common features, functions, and elements may not be redundantly described here.

Process 300 may begin by injecting a fuel such as the fuel 114/214 into a magnetic field such as the magnetic field 118/218 at least partially enclosed in a combustion chamber such as the combustion chamber 104/204 (task 302).

Process 300 may continue by producing a combustion region such as the combustion region 116/216 comprising electrically conductive species such as the electrically conductive species 120/220 by combusting the fuel 114/214 (task 304). The electrically conductive species 120/220 may comprise, for example but without limitation, an ionized gas such as the ionized gas 132/232, a free electron distribution such as the free electrons 134/234, a free radical population density such as the free radicals 136/236, or other conductive species.

Process 300 may continue by magnetically controlling the combustion region 116/216 using the magnetic field 118/218 operating on the electrically conductive species 120/220 (task 306).

Process 300 may continue by magnetically confining the combustion region 116/216 using the magnetic field 118/218 operating on the electrically conductive species 120/220 (task 308).

Process 300 may continue by operating on the electrically conductive species 120/220 using the magnetic field 118/218 to control at least one of: a dimension of the combustion region 116/216, a pressure of the combustion region 116/216, a flow of the electrically conductive species 120/220 through the combustion region 116/216, and a flow of the combustion region 116/216 (task 310).

Process 300 may continue by throttling a flow of the electrically conductive species 120/220 through the combustion region 116/216 using the magnetic field 118/218 operating on the electrically conductive species 120/220 (task 312).

Process 300 may continue by throttling a flow of the combustion region 116/216 such as the flow 238 using the magnetic field 118/218 operating on the electrically conductive species 120/220 (task 314).

Process 300 may continue by adaptively controlling a downstream property of a flow of the combustion region 116/216 by: increasing the magnetic field 118/218 in response to a peak of an upstream property of the flow of the combustion region, and decreasing the magnetic field 118/218 in response to a reduction of the upstream property (task 316). For example but without limitation, the downstream property may comprise a pressure, a velocity, or a density and the upstream property may comprise a heat release, a velocity, or a density.

Figure 4:
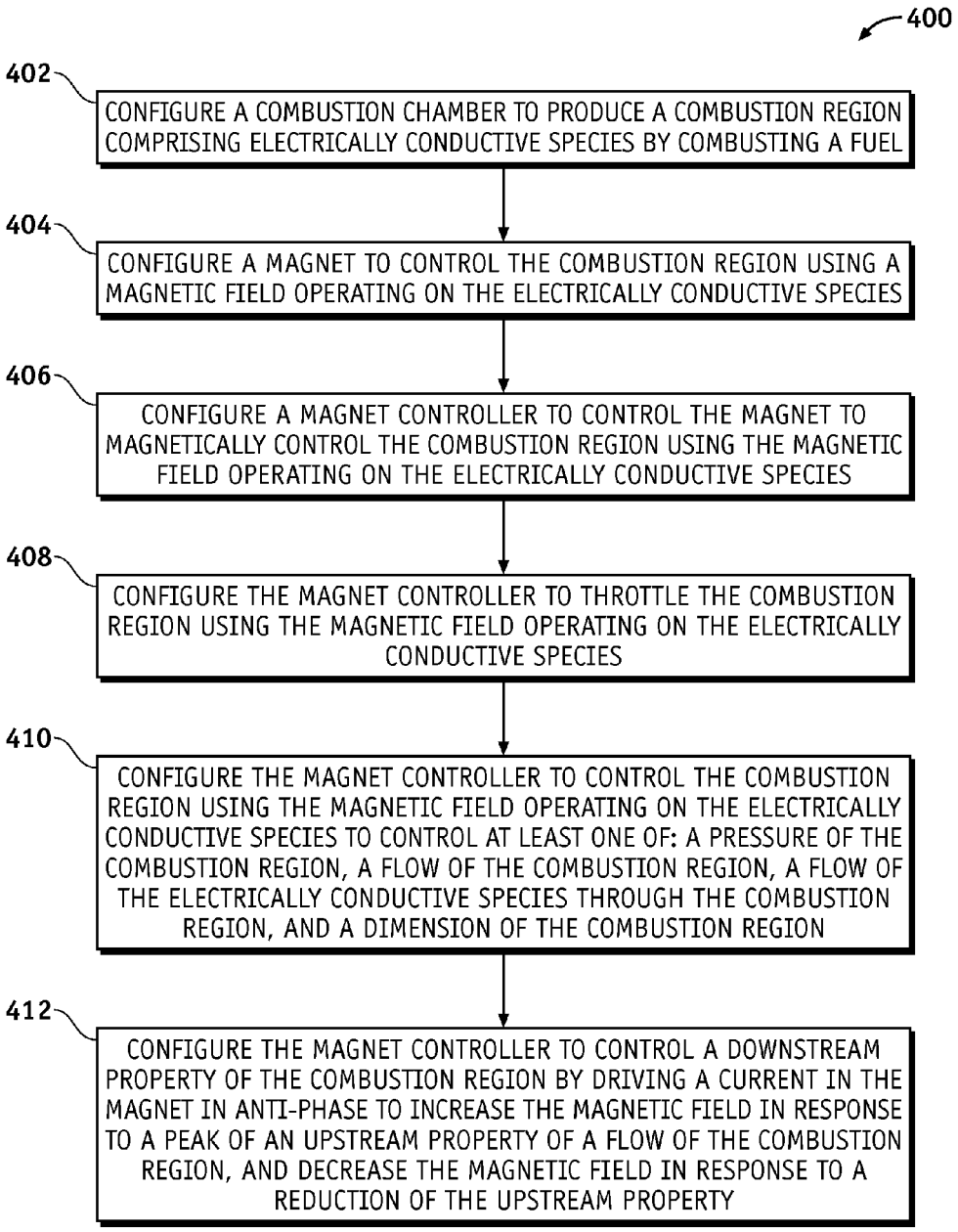
FIG. 4 is an illustration of an exemplary process for forming a magnetic combustion management system according to an embodiment of the disclosure.

FIG. 4 is an illustration of an exemplary process 400 for forming a magnetic combustion management system according to an embodiment of the disclosure. The various tasks performed in connection with process 400 may be performed mechanically, by software, hardware, firmware, computer-readable software, computer readable storage medium, or any combination thereof. The process 400 may be recorded in a computer-readable medium such as a semiconductor memory, a magnetic disk, an optical disk, and the like, and can be accessed and executed, for example, by a computer CPU such as the processor module 110/210 in which the computer-readable medium is stored.

For illustrative purposes, the following description of process 400 may refer to elements mentioned above in connection with FIGS. 1-2. In some embodiments, portions of the process 400 may be performed by different elements of the systems 100-200 such as: the fuel injector 102/202, the combustion chamber 104/204, the electromagnet 106/206, and the magnet controller 108/208, the fuel 114/214, the combustion region 116/216, the magnetic field 118/218, etc. It should be appreciated that process 400 may include any number of additional or alternative tasks, the tasks shown in FIG. 4 need not be performed in the illustrated order, and the process 400 may be incorporated into a more comprehensive procedure or process having additional functionality not described in detail herein.

Process 400 may begin by configuring a combustion chamber such as the combustion chamber 104/204 to produce a combustion region such as the combustion region 116/216 comprising electrically conductive species such as the electrically conductive species 120/220 by combusting a fuel such the fuel 114/214 (task 402). The electrically conductive species 120/220 may comprise, for example but without limitation, an ionized gas such as the ionized gas 132/232, a free electron distribution such as the free electrons 134/234, a free radical population density such as the free radicals 136/236, or other conductive species.

Process 400 may continue by configuring a magnet such as the electromagnet 106/206 to control the combustion region 116/216 using a magnetic field such as the magnetic field 118/218 operating on the electrically conductive species 120/220 (task 404).

Process 400 may continue by configuring a magnet controller such as the magnet controller 108/208 to control the magnet 106/206 to magnetically control the combustion region 116/216 using the magnetic field 118/218 operating on the electrically conductive species 120/220 (task 406).

Process 400 may continue by configuring the magnet controller 108/208 to throttle the combustion region 116/216 (e.g., throttle the flow 238) using the magnetic field 118/218 operating on the electrically conductive species 120/220 (task 408).

Process 400 may continue by configuring the magnet controller 108/208 to control the combustion region 116/216 using the magnetic field 118/218 operating on the electrically conductive species 120/220 to control at least one of: a pressure of the combustion region 116/216, a flow of the combustion region 116/216 such as the flow 238, a flow of the electrically conductive species 120/220 through the combustion region 116/216, and a dimension of the combustion region 116/216 (task 410). The pressure of the combustion region 116/216, the flow of the combustion region 116/216, and the dimension of the combustion region 116/216 may vary by varying a strength (e.g., direction and magnitude) of the magnetic field 118/218 based on for example operating conditions of an engine.

Process 400 may continue by configuring the magnet controller 108/208 to control a downstream property of the combustion region 116/216 by driving a current in the magnet in anti-phase to increase the magnetic field 118/218 in response to a peak of an upstream property of a flow of the combustion region, and decrease the magnetic field 118/218 in response to a reduction of the upstream property (task 412). For example but without limitation, the downstream property may comprise a pressure, a velocity, or a density and the upstream property may comprise a heat release, a velocity, or a density.

In this manner, embodiments of the disclosure act to compress and confine a flame, allowing engine operation without the flame directly impinging on a burner structure. Thermal load is reduced on burner supports and surrounding ducts, and operating life of burners is increased. In addition, a magnetic confinement and a flame compression can be modulated at high frequency, and the pressure output from each burner can be balanced and rapid chaotic pressure variations may be damped. Thereby, engine noise can be reduced and turbine blade lifetime increased.

Also, during lean engine operation, active flame control can prevent a flame from entering a chaotic sputtering mode which produces significant acoustic pulses capable of causing an anomaly in the turbine if resonances form. Prevention of chaotic combustion may allow use of lean fuel/air ratios, and may allow high temperature operation of a turbine since operational limitations on turbine blades are a function of stress and temperature. With reduced pressure pulsations there may be reduced physical stress on turbine blades, allowing increased tolerance for increased temperature of operation.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The above description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIGS. 1-2 depict example arrangements of elements, additional intervening elements, devices, features, or components may be present in an embodiment of the disclosure.

In this document, the terms "computer program product", "computer-readable medium", "computer readable storage medium", and the like may be used generally to refer to media such as, for example, memory, storage devices, storage unit, or other non-transitory media. These and other forms of computer-readable media may be involved in storing one or more instructions for use by the processor module 110/210 to cause the processor module 110/210 to perform specified operations. Such instructions, generally referred to as "computer program code" or "program code" (which may be grouped in the form of computer programs or other groupings), when executed, enable the systems 100 and 200.

As used herein, unless expressly stated otherwise, "operable" means able to be used, fit or ready for use or service, usable for a specific purpose, and capable of performing a recited or desired function described herein. In relation to systems and devices, the term "operable" means the system and/or the device is fully functional and calibrated, comprises elements for, and meets applicable operability requirements to perform a recited function when activated. In relation to systems and circuits, the term "operable" means the system and/or the circuit is fully functional and calibrated, comprises logic for, and meets applicable operability requirements to perform a recited function when activated.

The invention claimed is:

1. A method for magnetically managing combustion, the method comprising:

injecting a fuel into a magnetic field at least partially enclosed in a combustion chamber;

producing a combustion region comprising electrically conductive species by combusting the fuel;

magnetically controlling the combustion region using the magnetic field operating on the electrically conductive species;

adaptively controlling a downstream property of a flow of the combustion region by:

increasing the magnetic field in response to a peak of an upstream property of the flow of the combustion region; and decreasing the magnetic field in response to a reduction of the upstream property, wherein the downstream property comprises one of: a pressure, a velocity, and a density; and the upstream property comprises one of: a heat release, a velocity, and a density.

2. The method of claim 1, further comprising magnetically confining the combustion region using the magnetic field operating on the electrically conductive species.

3. The method of claim 1, further comprising operating on the electrically conductive species using the magnetic field to control at least one member selected from the group consisting of: a dimension of the combustion region, a pressure of the combustion region, a flow of the electrically conductive species through the combustion region, and a flow of the combustion region.

4. The method of claim 1, further comprising throttling a flow of the electrically conductive species through the combustion region using the magnetic field operating on the electrically conductive species.

5. The method of claim 1, further comprising throttling a flow of the combustion region using the magnetic field operating on the electrically conductive species.

6. A magnetic combustion management system comprising:

a combustion chamber operable to produce a combustion region comprising electrically conductive species by combusting a fuel;

a magnet operable to control the combustion region using a magnetic field operating on the electrically conductive species;

a magnet controller operable to control the magnet to magnetically control the combustion region using the magnetic field operating on the electrically conductive species, wherein the magnet controller is further operable to control the combustion region using the magnetic field operating on the electrically conductive species to control at least one member selected from the group consisting of: a pressure of the combustion region, a flow of the combustion region, a flow of the electrically conductive species through the combustion region, and a dimension of the combustion region.

7. The magnetic combustion management system of claim 6, wherein the magnet is further operable to magnetically confine the combustion region using the magnetic field operating on the electrically conductive species.

8. The magnetic combustion management system of claim 6, wherein the magnet controller is further operable to throttle a flow of the combustion region using the magnetic field operating on the electrically conductive species.

9. The magnetic combustion management system of claim 6, wherein the magnet controller is further operable to control a downstream property of the combustion region by driving a current in the magnet in anti-phase to:

increase the magnetic field in response to a peak of an upstream property of a flow of the combustion region; and decrease the magnetic field in response to a reduction of the upstream property.

10. The magnetic combustion management system of claim 6, wherein the combustion chamber is further operable to combust the fuel using at least one of: intermittent combustion, and continuous combustion.

11. The magnetic combustion management system of claim 6, wherein the electrically conductive species comprise at least one member selected from the group consisting of: an ionized gas, a free electron, and a free radical.

12. A method for forming a magnetic combustion management system, the method comprising:

configuring a combustion chamber to produce a combustion region comprising electrically conductive species by combusting a fuel;

configuring a magnet to control the combustion region using a magnetic field operating on the electrically conductive species;

configuring a magnet controller to control the magnet to magnetically control the combustion region using the magnetic field operating on the electrically conductive species; and configuring the magnet controller to throttle the combustion region using the magnetic field operating on the electrically conductive species.

13. The method of claim 12, further comprising configuring the magnet controller to control the combustion region using the magnetic field operating on the electrically conductive species to control at least one member selected from the group consisting of: a pressure of the combustion region, a flow of the combustion region, a flow of the electrically conductive species through the combustion region, and a dimension of the combustion region.

14. The method of claim 12, further comprising configuring the magnet controller to control a downstream property of the combustion region by driving a current in the magnet in anti-phase to:

increase the magnetic field in response to a peak of an upstream property of a flow of the combustion region; and decrease the magnetic field in response to a reduction of the upstream property.

* * * * *